US006487951B1

(12) United States Patent
Petkantchin

(10) Patent No.: US 6,487,951 B1
(45) Date of Patent: Dec. 3, 2002

(54) APPARATUS AND METHOD FOR FIRING A PROJECTILE

(75) Inventor: Latchezar Lazarov Petkantchin, Sofia (BG)

(73) Assignee: Bankware, Ltd., Sofia (BG)

( * ) Notice: Subject to any disclaimer, the term of this patent is extended or adjusted under 35 U.S.C. 154(b) by 36 days.

(21) Appl. No.: 09/638,229

(22) Filed: Aug. 14, 2000

(51) Int. Cl.[7] ..... F42B 12/68; F41F 5/00

(52) U.S. Cl. ..... 89/1.34; 102/504; 102/517; 42/78

(58) Field of Search ..... 102/504, 501, 102/517, 371, 524–527; 89/1.34; 42/78; 244/3.23

(56) References Cited

U.S. PATENT DOCUMENTS

| | | | | |
|---|---|---|---|---|
| 537,674 A | | 4/1895 | Collins | |
| 843,385 A | | 2/1907 | Behr | |
| 2,069,276 A | | 2/1937 | Ryan | |
| 2,396,666 A | | 3/1946 | Larvick | |
| 2,469,533 A | | 5/1949 | Wellcome | |
| 2,856,820 A | | 1/1958 | Schmued | |
| 2,849,955 A | | 9/1958 | Smathers | |
| 2,869,465 A | | 1/1959 | Villepigue | |
| 2,871,762 A | | 2/1959 | Schmued | |
| 2,938,430 A | | 5/1960 | Pion | |
| 2,946,261 A | | 7/1960 | Crockett | |
| 3,314,286 A | | 4/1967 | Hickerson et al. | |
| 3,424,409 A | | 1/1969 | Stanley | |
| 3,468,214 A | | 9/1969 | Worcester | |
| 3,547,382 A | | 12/1970 | Stanley | |
| 3,566,528 A | | 3/1971 | Musser | |
| 4,004,764 A | | 1/1977 | Burklund et al. | |
| 4,007,895 A | | 2/1977 | Payne | |
| 4,242,961 A | * | 1/1981 | Moredock et al. | 102/527 |
| 4,307,651 A | | 12/1981 | Batson et al. | |
| 4,505,179 A | | 3/1985 | Nelson et al. | |
| 4,590,698 A | * | 5/1986 | Finn | 42/78 |
| 4,607,814 A | | 8/1986 | Popov | |
| 4,776,255 A | | 10/1988 | Smith | |
| 4,996,924 A | | 3/1991 | McClain | |
| 5,164,540 A | * | 11/1992 | Chiarelli et al. | 102/526 |

FOREIGN PATENT DOCUMENTS

| | | | |
|---|---|---|---|
| GB | 15530 | * 1/1906 | 102/504 |
| GB | 13546 | * 11/1908 | 102/504 |
| GB | 189346 | * 11/1922 | 102/504 |

OTHER PUBLICATIONS

Advertisement for a rocket–deployed parachute. EAA Experimente, Jan. 1996, p. 35.

Description of a rocket–deployed ejection seat and parachute system, No date.

Prospectus for proposal from BRS, 1997.

Notice of discontinuance of business for Second Chantz, a manufacturer of rocket–deployed parachute systems. Notice indicates that company had manufactured such items since 1983, Oct. 1995.

* cited by examiner

*Primary Examiner*—Harold J. Tudor
(74) *Attorney, Agent, or Firm*—Merchant & Gould P.C.

(57) ABSTRACT

An apparatus and method for firing a projectile in which one part of the projectile rotates and the other part of the projectile does not rotate where is it used for delivering a line. The projectile firing apparatus includes a projectile having a part that rotates and a part that does not rotate, and further a barrel with a bore having spiraled grooves and at least two channels for the nonrotating part of the projectile to travel through when the projectile is fired. A line dragging system is mounted on the front of the barrel and engages to the nonrotating part of the projectile. The line dragging system is made of a wire frame including a cylindrical portion, engaging members, frame sides, and engaging locks. Upon firing the projectile, the rotating part moves through the bore of the barrel while the nonrotating part moves through the channels of the barrel. The nonrotating part of the projectile engages the line dragging system on its engaging members after exit of the barrel and delivers the line in flight. The rotational motion of the projectile allows the projectile to be stabilized in flight for better precision and range, while the nonrotational motion of the projectile allows a balanced and untangled line to be delivered to its destination.

12 Claims, 4 Drawing Sheets

FIG.1A
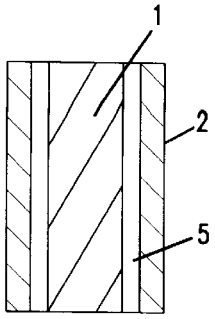
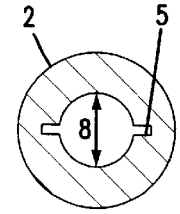
FIG 1B
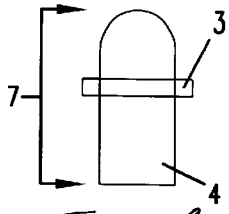
FIG 1C
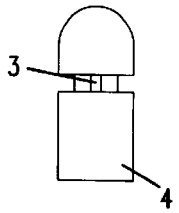
FIG 1D
FIG.2
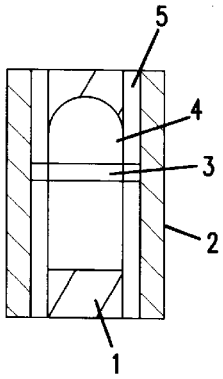
FIG.3A
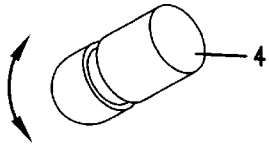
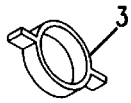
FIG.3B
FIG.4
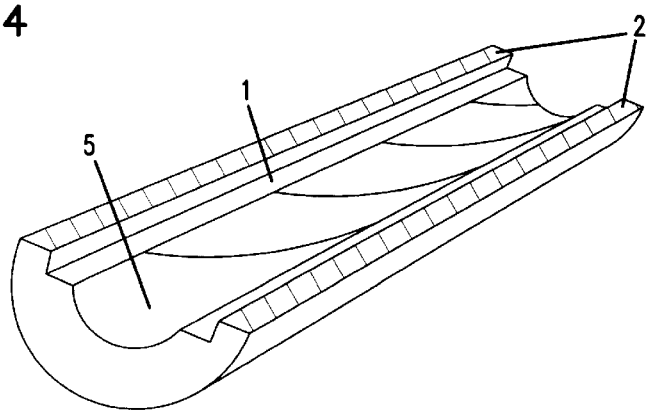

APPARATUS AND METHOD FOR FIRING A PROJECTILE

FIELD OF THE INVENTION

This invention relates to firing projectiles, and more particularly to an apparatus and method for firing a projectile in which one part of the projectile is rotating and the other part is not rotating. Also, the nonrotating part of the projectile is attached to a line to be delivered upon firing of the projectile.

BACKGROUND OF THE INVENTION

Previous projectiles to be fired would include using smooth bore launch tubes and firing a projectile with fins attached for stabilizing means, and where the line would be attached asymmetrically to the top of the projectile or on its side. The problem with this type of launcher and projectile is that it does not have the best accuracy and range, and the line attached would not be balanced in flight. Other methods have employed a self-stabilizing spinning projectile where the projectile is rapidly rotating around its central axis while being pushed through a rifled barrel. Although the rotating action of the projectile increases accuracy and range, the line attached to the projectile would also be rotating thereby twisting the line creating drag during the projectile's flight.

U.S. Pat. No. 4,996,924 to McClain discloses aerodynamic projectiles in which the projectiles have helical grooves and lands to promote spinning action of the projectile. A particular projectile is described wherein the projectile includes two parts, a conical nose and a main body, both with helical grooves, however the grooves of each part are oppositely oriented to create counter rotational action between the two parts at the same time upon firing. Ball bearings allow the two parts to rotate relative to each other while being connected. This projectile is not connected to a line, nor is one of the parts of the projectile not rotating during flight.

SUMMARY OF THE INVENTION

The present invention provides an apparatus and method for firing a projectile. The present invention provides an apparatus and method for firing a projectile in which one part of the projectile rotates while the other part is not rotating. The present invention reduces drag by stabilizing the flight of the projectile using a self-stabilization spinning technique, while the nonrotating part of the projectile moves through the barrel and can then be symmetrically connected to a line upon leaving the barrel. By rotating one part of the projectile and keeping the other part from rotating, the present invention is able to rotate a projectile and is able to carry a straight and untangled line for high accuracy and long range. Further, by symmetrically attaching the line upon firing, the projectile will maintain a balanced flight pattern also adding to accuracy and range.

One embodiment of firing a projectile in accordance with the principles of the present invention includes a projectile with two parts. Upon firing the projectile, one part is simultaneously rotating and the other part is not rotating. A barrel, which includes a bore having spiraled grooves, is used to fire this projectile wherein at least two straight symmetrical channels run along the inside of the barrel. The rotating part of the projectile will move along this bore having spiraled grooves in the barrel upon firing, while the nonrotating part of the projectile will move along the symmetrical channels of the barrel. A wire frame with a line connected is attached to the nonrotating part of the projectile and moves with this nonrotating part of the projectile through the channels inside of the barrel as the whole projectile is fired. Before the projectile leaves the barrel the frame and line are pointed forward and the projectile is pushing the frame connected to the nonrotating part through the channels inside of the barrel. After the projectile leaves the barrel the frame is pulled backward and locked into a position so that it is behind the projectile during flight. The projectile, in flight, is stabilized by its rotating portion while keeping the line untangled and balanced with its nonrotating portion.

A preferred embodiment of firing a projectile in accordance with the principles of the present invention includes a projectile having a part that rotates and a part that does not rotate and a barrel including a bore having spiraled grooves and at least two symmetrical grooves that form straight channels along the length and inside the barrel. Further, a line dragging system is mounted to the front end of the barrel, which is made of a wire frame, and includes an attached line, and engaging members connectable to the nonrotating part of the projectile. The wire frame is positioned at the inner diameter of the front end of the barrel. The engaging members of the line dragging system are symmetrically in line with the exit openings of the barrel channels. The engaging members contain an engaging lock for the nonrotating part of the projectile to travel into the engaging members and connect the entire line dragging system. As the projectile is fired, the rotating part of the projectile is pushed through the bore of the barrel while rotating. The nonrotating part of the projectile moves through the channels of the barrel, not rotating, and after leaving the barrel it travels into the engaging members and engages the lock contained in the engaging members. The line dragging system is now symmetrically attached to the projectile while in flight. The attached line is connected to the frame sides of the line dragging system. The rotation of one part of the projectile allows for stabilization of the flight pattern thereby attaining high accuracy and range. Also, the symmetrical attachment of the line dragging system to the nonrotating part of the projectile balances the projectile, during flight, increases accuracy and range, and further delivers a straight untangled line.

These advantages and features of the novel apparatus and method characterizing the invention are pointed out with particularity in the claims annexed hereto and forming a part thereof. However, for a better understanding of the inventive method, its advantages and objectives attained by its use, reference should be made to the drawings which form a further part hereof, and to the accompanying description, in which there is described a preferred embodiment of the invention.

BRIEF DESCRIPTION OF THE DRAWINGS

FIG. 1A is a side view of one embodiment of a projectile in accordance with the principles of the present invention.

FIG. 1B represents a side view of one embodiment for a first rotating part of the projectile of FIG. 1A.

FIG. 1C represents a cross sectional view of one embodiment of a barrel in accordance with the principles of the present invention.

FIG. 1D represents a partial axial cross sectional view of the barrel of FIG. 1C.

FIG. 2 is an axial cross sectional view of the barrel of FIG. 1 with side view of the whole projectile of FIG. 1 inside the barrel.

FIGS. 3*a* and 3*b* are perspective views of the rotating and nonrotating parts of the projectile of FIG. 1.

FIG. 4 is a perspective'sectional view of the barrel of FIG. 1.

DETAILED DESCRIPTION OF THE PREFERRED EMBODIMENT

Figure 5A:
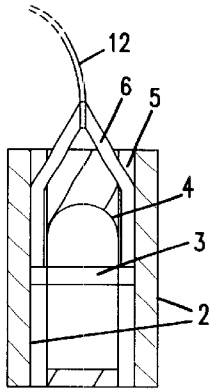
FIGS. 5*a* and 5*b* represent an axial cross sectional view of the barrel of FIG. 1 with a side view of the projectile of FIG. 1, one embodiment of a frame, in accordance with the principles of the present invention, with a line connected, and a side view of the projectile in flight attached to the frame with one embodiment of a line connected in accordance with the principles of the present invention.

Referring now to the drawings, with reference to FIGS. 1, 2, 3 and 4, the barrel is referred to as numeral 2. Within the barrel 2 the channels 5 are located on the side and along the length and inside of the barrel 2 with the bore 1 having spiraled grooves in between the straight channels 5. The whole projectile is referred to as numeral 7. The nonrotating part of the projectile and the rotating part of the projectile are referred to as numerals 3 and 4, respectively. The inner diameter of the barrel 2 is referred to as 8 and will be discussed later. The rotating part of the projectile 4 is shown to be positioned preferably in the bore 1 of the barrel 2, while the nonrotating part 3 of the projectile 7 is positioned preferably on the channels 5 at the front end of the barrel 2. In addition the rotating part 4 of the projectile 7 is connected to the nonrotating part 3 of the projectile 7 to allow relative rotation. Upon firing the projectile 7, the spinning of the rotating part 4 moving through the bore I of the barrel 2, relative to the nonrotating part 3 moving through the channels 5 of the barrel 2, promotes firing a projectile 7 wherein one part is simultaneously rotating while the other part is not rotating. The rotating part 4 induces a self-stabilizing spin on the projectile 7 during flight.

Figure 5B:
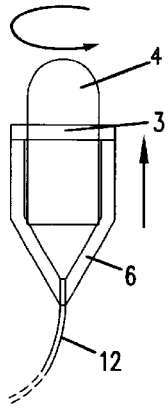

With reference to FIGS. 5*a* and 5*b*, one embodiment of the present invention introduces a frame 6 connected to a line 12 that is attached to the nonrotating part 3 of the projectile 7 before firing. In FIG. 5*a*, before the projectile 7 leaves the barrel 2, the frame 6 with the line 12 connected is pointing forwards connected to the nonrotating part 3, and the projectile 7 is pushing it upon firing. After the projectile 7 leaves the barrel 2, the frame 6 is pulled back and locked into a position behind the projectile 7. In FIG. 5*b*, the projectile 7, in flight, pulls the frame 6 with the line 12 attached, which is engaged with the nonrotating part 3 of the projectile 7. Simultaneously, the rotating part 4 is rotating relative to the nonrotating part 3. The rotation and nonrotation of the projectile 7 allows for both stabilization and balance of the line 12 in flight. These two features provide for better precision and range when firing projectile 7.

Figure 6B:
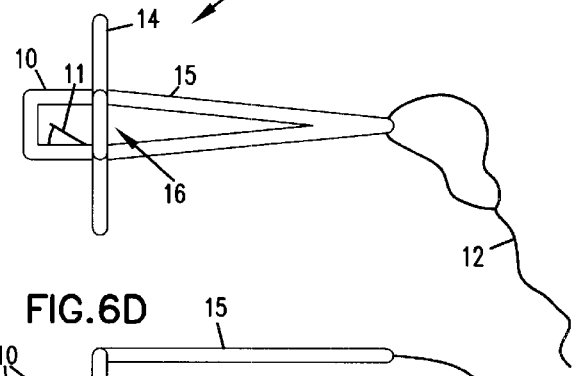
FIGS. 6*a–d* is a perspective view of one embodiment of a line dragging system in accordance with the principles of the present invention, and top, side and front diagrammatic views of the line dragging system.
Figure 6C:
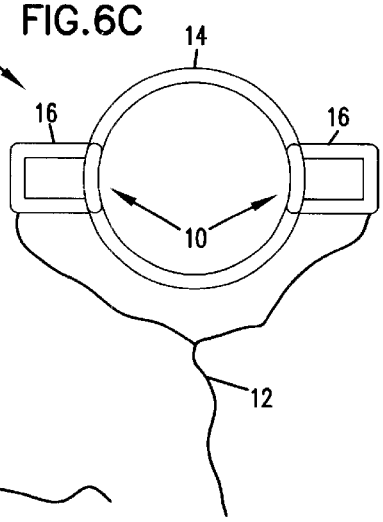
Figure 6D:
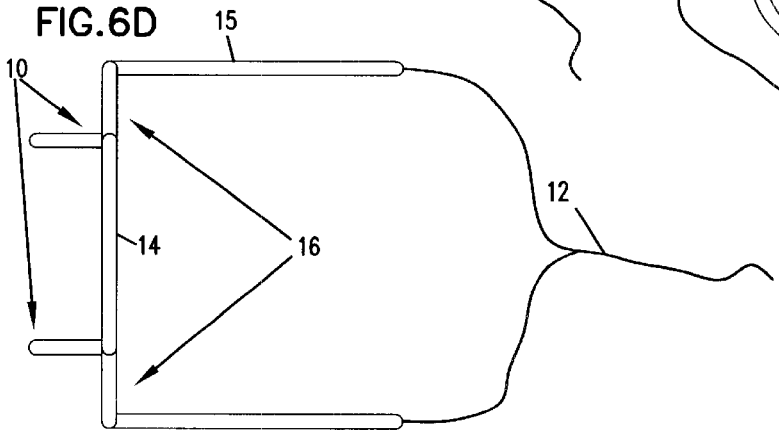
Figure 6A:
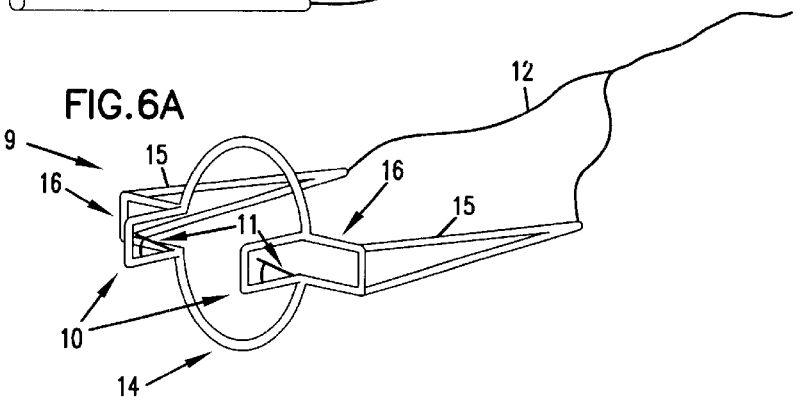

Turning to FIGS. 6*a–d*, the preferred embodiment illustrates that a line dragging system 9 is not initially attached to the projectile 7 before firing. Instead, the line dragging system 9 is mounted at the front end of the barrel 2 to later be engaged with the nonrotating part 3 of the projectile 7 after leaving the barrel 2. FIG. 6*a* shows the features of the line dragging system 9 that is made of a wire frame, and includes a cylindrical portion 14, engaging members 10 that protrude perpendicularly out the front of the cylindrical portion 14 of the wire frame and is also connecting to structural supports 16 that are in the same plane as the cylindrical portion 14, and further a line 12 attached to the back ends of the frame sides 15 that protrude perpendicularly out the back of the structural supports 16 of the line dragging system 9.

Figure 7A:
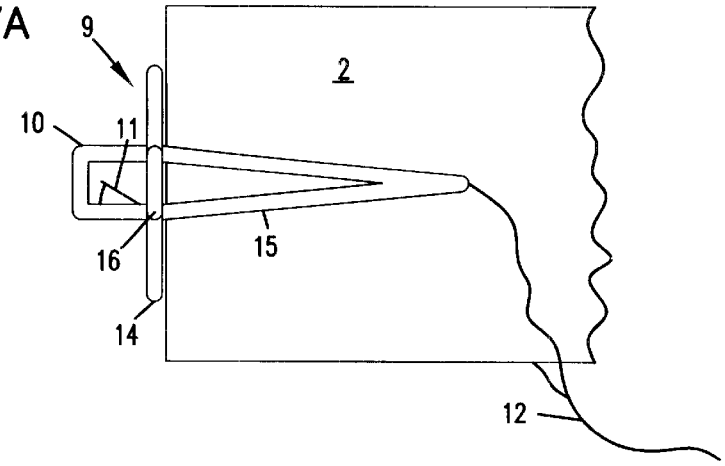
FIGS. 7*a–c* represents top, side and front diagrammatic views of the line dragging system of FIG. 6 attached to the barrel of FIG. 1.
Figure 7B:
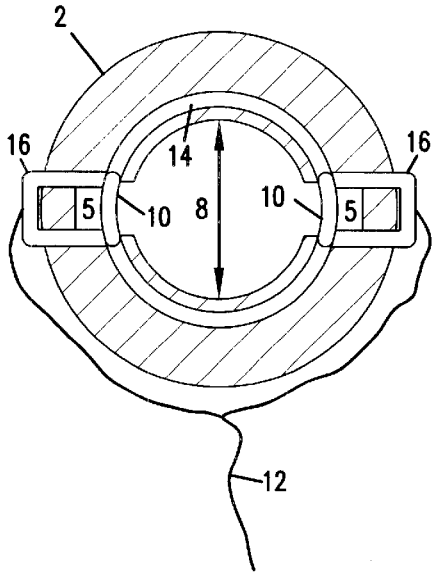
Figure 7C:
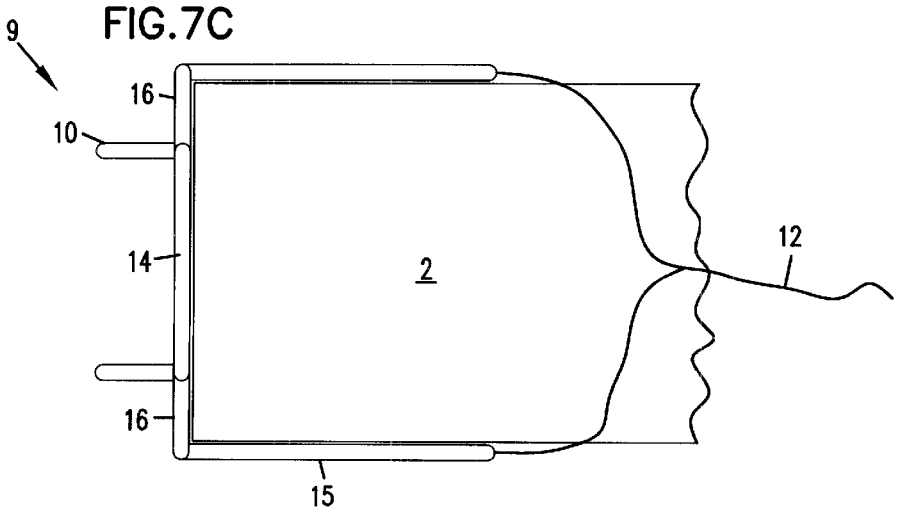
Figure 8A:
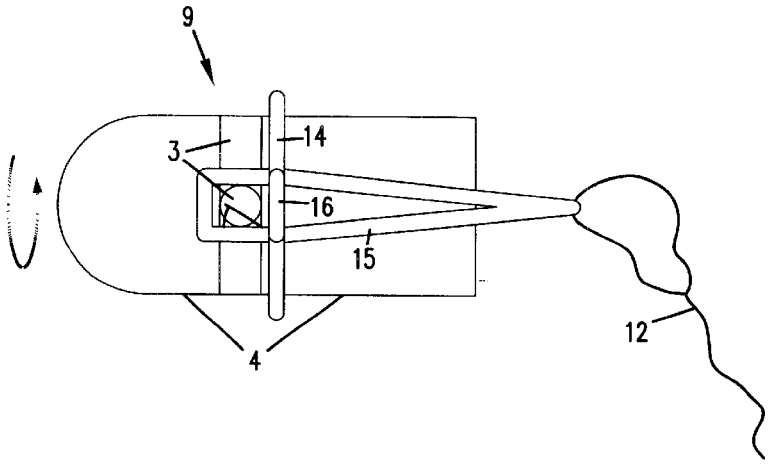
FIGS. 8*a–c* represents top, side and front diagrammatic views of the line dragging system of FIG. 6 engaged with the projectile of FIG. 1.
Figure 8B:
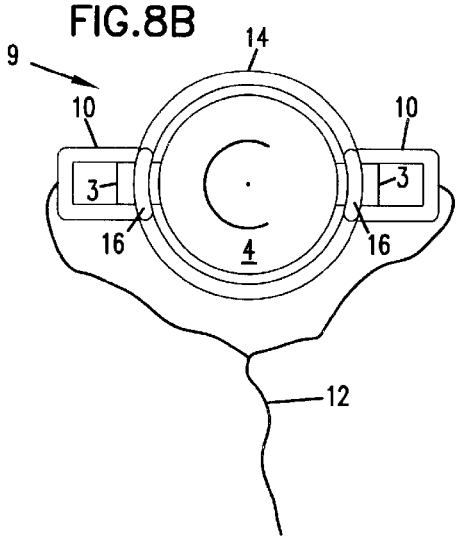
Figure 8C:
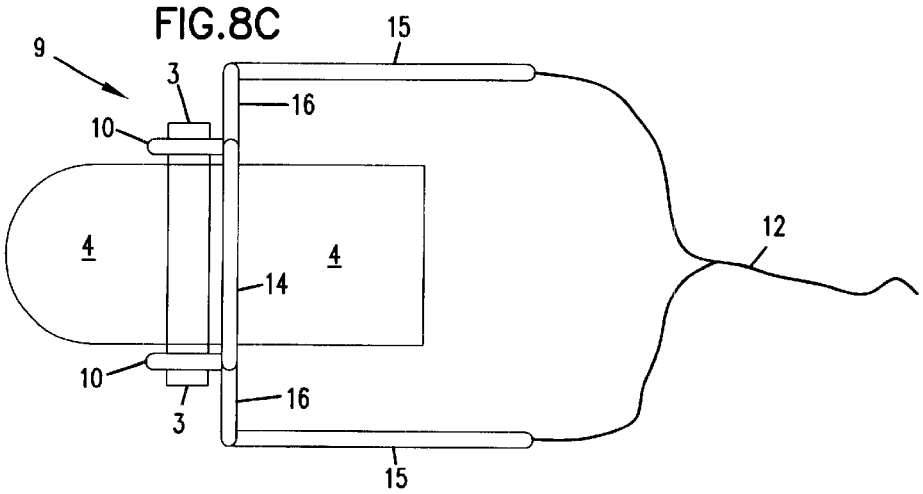

As depicted in FIGS. 7 and 8, the cylindrical portion 14 of the line dragging system 9 is mounted around the inner diameter 8 of the barrel 2 and is larger than the diameter of the rotating part 4 of the projectile 7. The engaging members 10 and structural supports 16 reside in line with and in front of the exit openings of channels 5 of the barrel 2. This method of mounting allows the nonrotating part 3 of the projectile 7 to connect to the engaging members 10 of the line dragging system 9 after leaving the channels 5 of the barrel 2. At the same time the line dragging system 9 does not have contact with the rotating part 4 of the projectile 7 as the diameter of the cylindrical portion 14 is larger than the diameter of the rotating part 4. Equally, the engaging members 10 are spaced apart at a distance larger than the diameter of the rotating part 4 so as not to contact the rotating part 4 of the projectile. The height of the structural supports 16 is such to allow ample space for the nonrotating part 3 of the projectile 7 to pass through to the engaging members 10. An engaging lock 11 lies within the engaging members 10 so when the nonrotating part 3 of the projectile 7 travels out of the channels 5, through the structural supports 16 and into the engaging members 10 it engages with the entire line dragging system 9. When the line dragging system 9 is mounted, the frame sides 15 of the line dragging system 9 are located on the outside of the barrel 2 with the line 12 connected. Upon firing, the nonrotating part 3 of the projectile 7 will not be rotating as it passes through the channels 5 of the barrel 2. The rotating part 4 of the projectile 7 will simultaneously be rotating while it passes through the bore 1 of the barrel 2.

After leaving the barrel 2, the projectile 7 is in flight and has a rotating motion originating from the spinning of the rotating part 4. In addition, the nonrotating part 3 is not rotating and attached to and carrying the line dragging system 9. The spinning of the rotating part 4 provides self-stabilization of the projectile while the nonrotating part 3 is not rotating and carries a straight and untangled line 12. The symmetrical positioning of the line 12 around the nonrotating part 3 of the projectile allows for a balanced line 12 to be delivered. With the line dragging system 9 mounted on the outside of the barrel 2, the barrel 2 can be as long as needed so the dragging projectile 7 will gain enough speed and spin of its rotating part 4 to achieve very high precision and long range.

It is to be understood that while certain embodiments of the present invention have been illustrated and described, the invention is not limited to the specific forms or arrangements of the parts described and shown.

I claim:

1. A projectile for firing through a barrel having a bore, said projectile comprising:

a) a first part, said first part being positionable in said bore of said barrel so as to engage spiraled grooves of said bore, said first part being rotatable through said barrel upon firing said projectile;

b) a second part rotatably connected with said first part, said second part including at least two radially outwardly extending symmetrical portions being positionable so as to not engage said spiraled grooves of said barrel and to engage channels of said barrel, said second part being nonrotating through said barrel upon firing said projectile; and said projectile being a two part projectile, said two part projectile being said first part and said second part.

2. The projectile according to claim 1, wherein upon firing through said barrel, said first part of said projectile simultaneously rotates for spin stabilization while said second part of said projectile does not rotate.

3. A projectile firing apparatus comprising:

a barrel including an inner diameter defining a bore extending longitudinally therethrough, said bore having spiraled grooves therein, said barrel defining at least two oppositely disposed symmetrical channels extending longitudinally therethrough and adjacent said inner diameter of said bore;

a two part projectile disposed within said barrel for firing said projectile through said barrel, said projectile including a first part positioned in said bore and engaged with said spiraled grooves of said bore, said first part being rotatable through said barrel upon firing said projectile, and a second part rotatably connected with said first part, said second part including at least two radially outwardly extending symmetrical portions not engaged with said spiraled grooves of said barrel and engaged with said channels of said barrel, said second part being nonrotating through said barrel upon firing said projectile when said portions travel through said channels of said barrel.

4. The projectile apparatus according to claim 3, wherein said channels being straight symmetrical channels extending longitudinally through said barrel, said channels having a path for said portions of said second part to travel along said barrel.

5. The projectile firing apparatus according to claim 3, wherein upon firing, said first part of said projectile simultaneously rotates for spin stabilization while said second part of said projectile does not rotate.

6. The projectile firing apparatus according to claim 3, wherein said bore provides a path for said first part of said projectile to travel along inside of said barrel.

7. The projectile fi ring apparatus according to claim 3, further comprising a line dragging system connectable with said projectile, said line dragging system mounted on a front of said barrel, said line dragging system including a frame, a line attached to said frame, and engaging members, said engaging members engageable with said second part of said projectile thereby connecting said projectile to said line dragging system as said projectile exits said barrel.

8. The projectile firing apparatus according to claim 7, wherein said engaging members being aligned with exit openings of said channels enabling for said line dragging system to be symmetrically connectable with said second part of said projectile upon release from said barrel, thereby balancing said line and projectile during flight.

9. The projectile firing apparatus according to claim 8, wherein said line dragging system including an engaging lock connected to each of said engaging members, said engaging locks engageable with said second part of said projectile as said second part of said projectile travels into said engaging members and engages said line dragging system.

10. A method for firing a projectile from a bored barrel carrying an attachment, which comprises:

providing a two part projectile including a first part and a second part rotatably connected with said first part and a barrel having a longitudinally extending bore with spiraled grooves and at least two channels oppositely disposed and extending longitudinally therethrough;

positioning said first part in said bore of said barrel, said first part engaging said spiraled grooves of said barrel, said first part rotating upon firing said projectile and exit of said projectile from said barrel;

positioning at least two portions of said second part in said barrel, said portions engaging said channels of said barrel, said second part being nonrotating through said barrel upon firing said projectile and exit of said projectile from said barrel;

mounting an attachment to said barrel engageable with said second part of said projectile when said projectile exits said barrel and;

firing said projectile so as to simultaneously rotate said first part of said projectile in said bore of said barrel, and further while not rotating said second part of said projectile outside said bore upon firing said projectile; and engaging said attachment with said second part so as to carry said attachment.

11. The method of claim 10, wherein mounting said attachment including mounting a line dragging system to a front end of-the barrel, said line dragging system being engageable with the second part of the projectile, said line dragging system carrying a line.

12. The method of claim 11, wherein the step of mounting a line dragging system to the end of the barrel to be attached to the second part of the projectile, including symmetrically engaging the second part of the projectile after the projectile leaves the barrel.

* * * * *